United States Patent [19]

Nadolny et al.

[11] Patent Number: 4,468,828

[45] Date of Patent: Sep. 4, 1984

[54] LEANING TOOL

[76] Inventors: Henry Nadolny; Henryka A. Nadolna, both of 5045 N. Mango Ave., Chicago, Ill. 60630

[21] Appl. No.: 428,571

[22] Filed: Sep. 30, 1982

[51] Int. Cl.[3] ..... A47L 1/02; A47L 11/02

[52] U.S. Cl. ..... 15/97 R; 15/28; 15/244 R

[58] Field of Search ..... 15/28, 29, 23, 24, 97 R, 15/97 A, 244 R

[56] References Cited

U.S. PATENT DOCUMENTS 3,026,552 3/1962 Price ..... 15/28

*Primary Examiner*—Timothy F. Simone

*Attorney, Agent, or Firm*—John J. Kowalik

[57] ABSTRACT

A cleaning tool having an elongated hand-carried structure including a motor at one end and a shaft extending to the other end. A cleaning tool of distortable material has a socket sleeved on the shaft and a latch connects the socket to the structure. A pair of swing links are mounted on the shaft which swing apart and distort the elastomeric material of the tool to stabilize it and to compress it and thus interlock therewith.

4 Claims, 6 Drawing Figures

LEANING TOOL

BACKGROUND OF THE INVENTION

This invention relates to cleaning brushes and the like which incorporate an electrically powered basic unit to which various accessories are attached. Such accessories usually consist of an assortment of brushes and the like for various chores. Tools of the generic type under consideration are shown in U.S. Pat. Nos. 2,904,804; 3,343,192; 4,131,966 and 4,250,587.

SUMMARY OF THE INVENTION

This invention is directed to a novel cleaning device which is made of easily separable parts so constructed as to facilitate assembly.

The invention contemplates a device which has a plastic housing encasing an electric motor at its upper end and having an elongated tubular sheath which encloses a propelling shaft, the lower end of which incorporates a latching device for tools such as sponges, mop heads, brushes which are adapted to snap into the latch.

It is also an object of the invention to provide a novel counterbalancing stabilizing assembly for holding the tools on the shaft. The tools in question are normally unstable sponges which tend to distort unequally due to contrifugal forces and unequalized nonhomogenous distribution of the cellular materials.

A primary object of the invention is to provide a plurality of pendular elements on the end of the mounting shaft which pursuant to high speed rotation of the shaft will swing outwardly into the encasing sponge which may be smooth or brush textured and which thus compresses the surrounding material and serves as an interlock therewith and also tends to balance the structure at opposite sides of the mounting shaft.

The invention provides a novel holder which has a long shank between the motor and the tool and thus is insertable into water or other fluids without danger of shorting the electrical components.

A further object is to provide the mechanism with an elongated body which is molded about the shaft bearings and seals and which is clampingly held at one end by a pair of housing halves which also encase the motor and control switches.

These and other objects and advantages inherent in and encompassed by the invention will become more apparent from the specification and drawings, WHEREIN.

DESCRIPTION OF THE INVENTION

Figure 1:
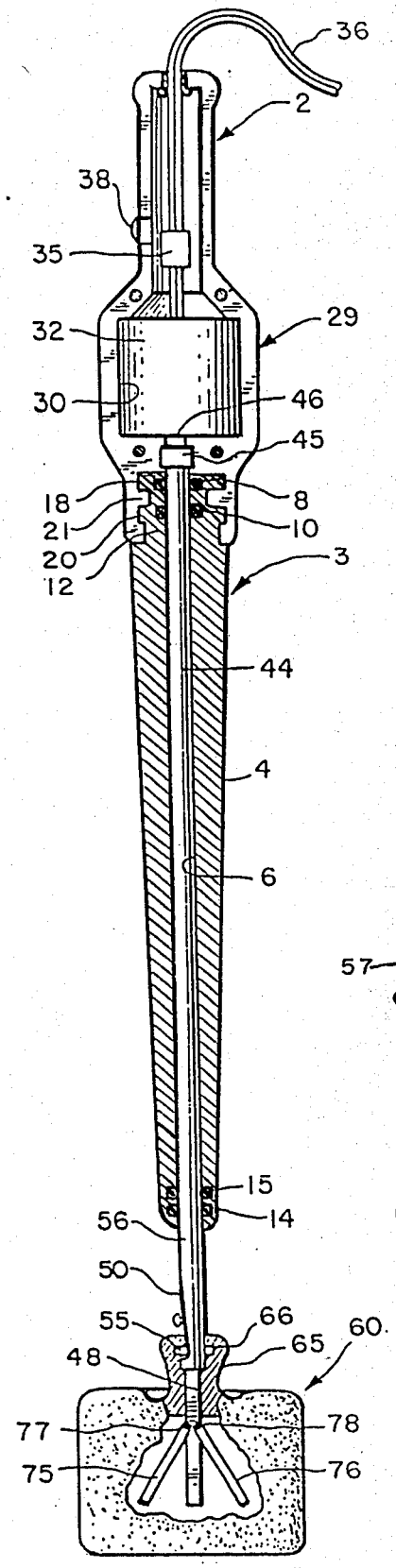
FIG. 1 is a longitudinal sectional view of the device.
Figure 2:
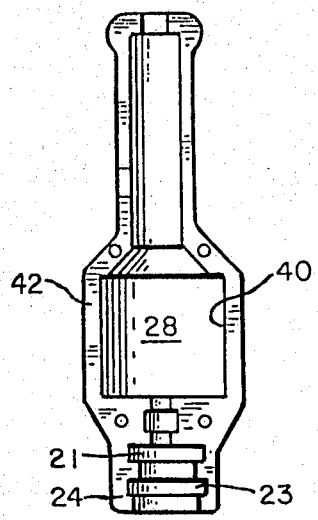
FIG. 2 is inner side view of one hald of the housing.
Figure 3:
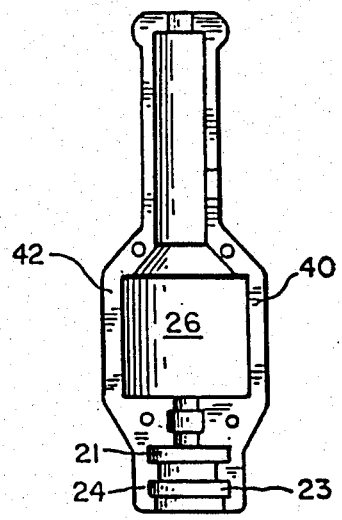
FIG. 3 is the inner side view of the other half of the housing.
Figure 4:
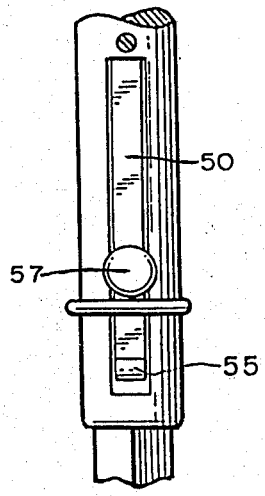
FIG. 4 is a side view of a portion of the device showing the latch in front view.
Figure 5:
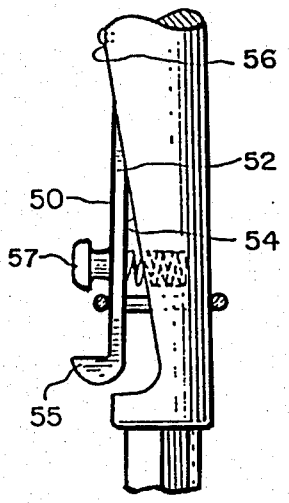
FIG. 5 is a side view of the latch and structure shown in FIG. 4.
Figure 6:
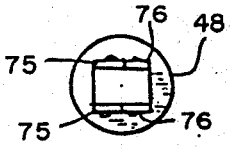
FIG. 6 is a bottom view of the shaft end.

The invention herein disclosed in the drawings comprises a cleaning tool generally designated 2 particularly adapted for cleaning bathrooms and the like and comprises an elongated body 3 including a plastic tubular shank portion 4 with an internal longitudinal bore 6.

A bearing 8 and seal 10 are molded within the upper end portion 12 and a bearing and seal 14 and 15 are molded in the lower end portion of the shank coaxial with the shaft bore 6.

The upper end portion 12 of the shank is of reduced diameter and is formed with a pair of annular rings 18 and 20 which are received in complementary semi-annular grooves 21, 23 on the lower end portions 22, 24 of a pair of counterparts 26, 28 of a housing generally designated 29 and which provides a cavity 30 intermediate its upper and lower ends. An electric motor is snugly fitted into the cavity 30.

The motor 32 is connected to a switch 35 which is connected to an electric cord 36 which extends through the upper end of the housing. The switch may have an external magnetic actuator 38 of well known type which may be manually manipulated to turn the motor on or off. The two halves of the housing may be suitably bonded or interlocked along their mating edges 40,42 to form a water-impervious structure.

A shaft 44 extends through the bore 16 and the seals and bearings and at its upper end is fitted into a coupling 45 which is part of the armature shaft 46 of the motor and the shaft 44 is driven thereby.

The lower end 48 of the shaft is non-round, preferable rectangular, and has a latch associated therewith which comprises a spring leaf 52 fitted into an external notch 54 in the body shank and flexible radially thereof to move the hook end 55 into concealment within the peripheral contour 56 of the shank portion, the spring leaf 52 being digitally actuated by a button 57 on the leaf intermediate its ends, inwardly of the notch.

A head or implement 60 is attachable to the shaft. The implement has a deep socket portion 65 and bore 68 which sleeves over the quadrilateral end of the shaft and the upper end is formed with an internal annualar groove 66 into which the hook end 55 of the latch extends after having passed through the upper end of the bore, attendant to the latch being held in concealed position within the body notch, and then being released.

It will be seen that the implement is formed of rather unstable sponge-like material to be highly absorbent of fluid soaps and other cleaning solutions and surface impregnated with light abrasives such as are used for cleaning lavatories etc.

In the present instance the implement 60 is provided with brush bristles.

It will be noted that in the brush implement only the upper end portion has the more rigid plastic socket and thus the lower end of the shaft extends into the soft-textured sponge-like elastomeric material, It will be noted that a pair of pendular implement implement rigidifying and holding members 75,76 preferably made of metal are shown swung apart in FIG. 1. These elements are pivoted by pins 77,78 at their upper ends to the shaft on axis transverse to the shaft and normally would merely hang down in a non-obstructing position within the normal peripheral contour of the shaft for easy insertion and withdrawal with respect to the socket of the associated tool. However, as the shaft and tool rotate, the balancing elements 75,76 swing outwardly against the compressive resistance of the sponge material of the respective implement and augment the interlock with the shaft and aid in stabilizing the shape of the tool head. This feature also inhibits tearing of the material and provides a rigidifying body within the head.

A novel improved tool has been provided which represents the best made. However, it will be apparent that various embodiments will become obvious to those skilled in the art which fall within the scope of the appended claims.

I claim:

1. A cleaning device comprising a stem portion and a housing portion comprising a plurality of pieces assembled about one end of the stem portion, a motor housed within said housing, a drive shaft journaled within said stem portion and having one end coupled with the motor and having a second end extending from said stem portion, a tool having a flexible socket portion providing a connection with said second end of the shaft, and rigid means pendulously mounted on the shaft for swinging radially outwardly from the shaft pursuant to rotation thereof and engaging and distorting said socket portion for releasably interlocking the tool with the shaft and retractable upon said shaft stopping rotation to release from said socket portion and thereby permit ready removal of the tool from the shaft.

2. The invention according to claim 1 and manually operable additional means for interlocking the shaft with the tool.

3. The invention according to claim 1 and said rigid means comprising unyielding link means swingably mounted on the shaft.

4. The invention according to claim 3 and said tool comprising a portion made of resilient distortable material disposed for distortion by said link means attendant to centrifugal outward extension of said link means pursuant to rotation of the shaft.

* * * * *